US007754024B2

(12) United States Patent
Koch et al.

(10) Patent No.: US 7,754,024 B2
(45) Date of Patent: Jul. 13, 2010

(54) CROCKERY BASKET FOR A DISHWASHER MACHINE, COMPRISING AN INTENSIVE WASHING ZONE

(75) Inventors: Stephan Koch, Detmold (DE); Dirk Wegener, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 1035 days.

(21) Appl. No.: 10/597,137

(22) PCT Filed: Jan. 10, 2005

(86) PCT No.: PCT/EP2005/000123

§ 371 (c)(1),
(2), (4) Date: Jul. 12, 2006

(87) PCT Pub. No.: WO2005/065519

PCT Pub. Date: Jul. 21, 2005

(65) Prior Publication Data

US 2007/0006903 A1 Jan. 11, 2007

(30) Foreign Application Priority Data

Jan. 12, 2004 (DE) ..... 10 2004 001 775

(51) Int. Cl.
*B08B 3/00* (2006.01)

(52) U.S. Cl. ..... 134/56 D; 134/137; 134/144

(58) Field of Classification Search ..... 134/56 D, 134/137, 144

See application file for complete search history.

(56) References Cited

U.S. PATENT DOCUMENTS

| | | | | |
|---|---|---|---|---|
| 3,463,173 | A | 8/1969 | Goldman | |
| 7,445,013 | B2 * | 11/2008 | VanderRoest et al. | 134/56 D |
| 2003/0192578 | A1 * | 10/2003 | Ochoa et al. | 134/176 |

FOREIGN PATENT DOCUMENTS

| | | | |
|---|---|---|---|
| DE | 74 17 444 | U | 10/1974 |
| DE | 19624891 | A1 | 10/1997 |
| DE | 19847151 | A1 | 4/2000 |
| DE | 10162501 | A1 | 7/2003 |
| DE | 10162505 | A1 | 7/2003 |
| DE | 102004022024 | A1 | 12/2005 |
| FR | 1 571 450 | A | 6/1969 |

OTHER PUBLICATIONS

International Search Report for International Application No. PCT/EP2005/000123, date of mailing Apr. 4, 2005.

* cited by examiner

*Primary Examiner*—Michael Barr
*Assistant Examiner*—Jason Heckert
(74) *Attorney, Agent, or Firm*—Leydig, Voit & Mayer, Ltd.

(57) ABSTRACT

A dishwasher apparatus includes a dish rack having a wire member, and a feed tube for a spray arm rotatably disposed beneath the dish rack. An intensive washing zone is provided in a region of the dish rack, the intensive washing zone including a rod-shaped pipe element attached to the wire member and having an outlet nozzle. A pipe branch for the intensive washing zone is provided, the pipe branch being disposed in a region of the feed tube and communicating with the pipe element via a T-piece. An actuator is provided that cooperates with the pipe element so as to enable the intensive washing zone to be activated and deactivated.

11 Claims, 5 Drawing Sheets

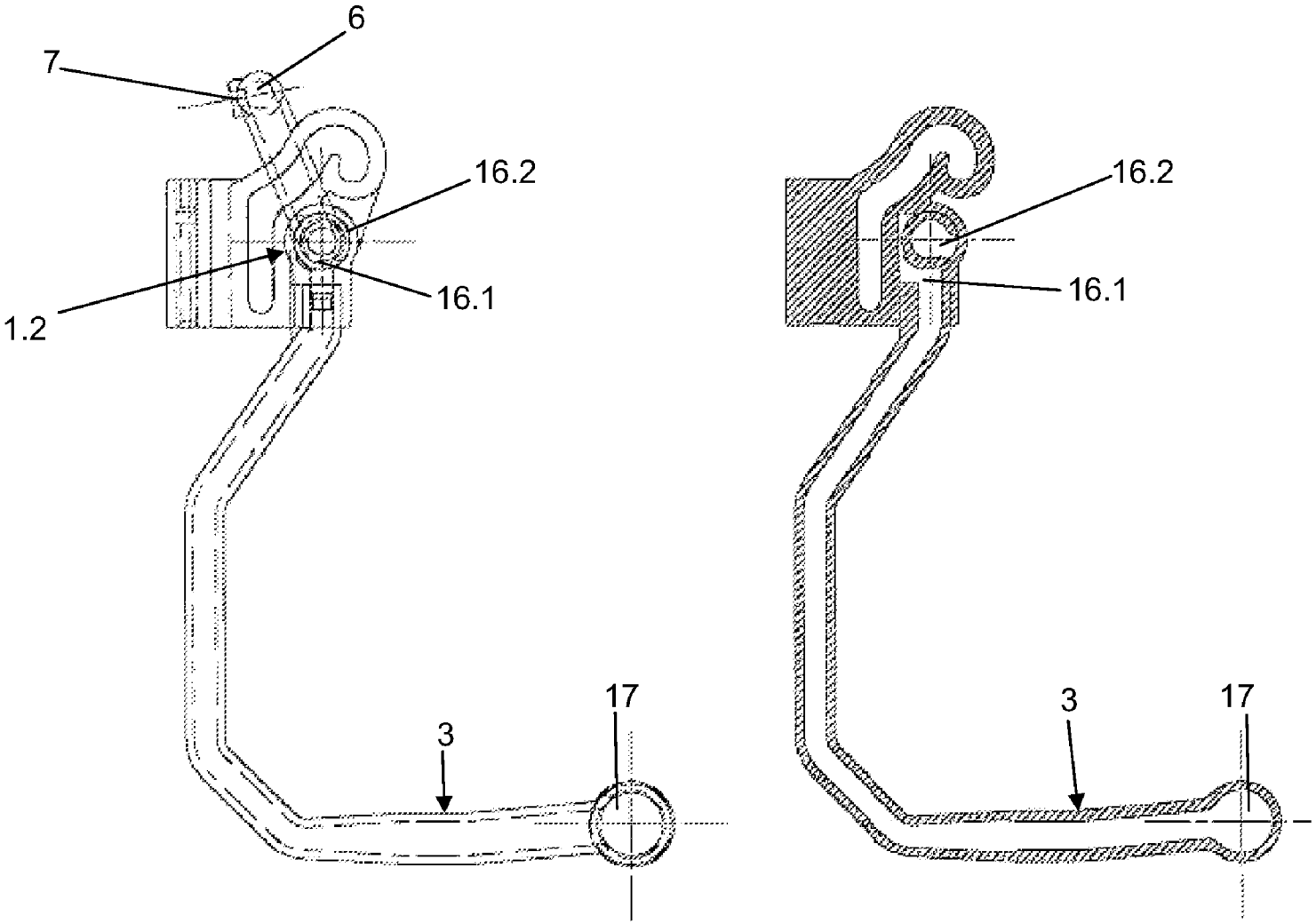
Fig. 3.1

CROCKERY BASKET FOR A DISHWASHER MACHINE, COMPRISING AN INTENSIVE WASHING ZONE

CROSS REFERENCE TO PRIOR APPLICATION

This is a U.S. national phase application under 35 U.S.C. §371 of International Patent Application No. PCT/EP2005/000123, filed Jan. 10, 2005, and claims benefit of German Patent Application No. 10 2004 001 775.1, filed Jan. 12, 2004 which is incorporated by reference herein. The International Application was published in German on Jul. 21, 2005 as WO 2005/065519 A1 under PCT Article 21(2).

The present invention relates to a dish rack for a dishwasher, including a feed tube for a spray arm that is rotatably mounted beneath the rack, a pipe branch being disposed in the region of the feed tube, for an intensive washing zone provided in the region of the dish rack.

BACKGROUND

In dishwashers, items to be washed are held in at least one dish rack and acted upon by wash water from below and/or above. The wash water is supplied to the items to be washed, for example, via a rotatable spray arm mounted beneath the dish rack. The spray arm is supplied with wash water by a circulating pump, which circulates the wash water within the dishwasher.

These prior art rotating nozzle arms produce so-called spray shadows, so that, especially in these regions, the spray jets issuing from the spray arm do not always effectively reach the items to be washed. Such a spray shadow occurs especially in the region of a two-level cup support (see, for example, DE 102004022024.7), the upper cup support being pivotably mounted in the dish rack. It is then desirable to provide special additional spray means to account for these regions, and also for the different shapes of the items to be washed, in order to thereby achieve effective cleaning and/or to allow the washing agent to be used in a controlled manner.

German document DE 198 47 151, for example, describes a dishwasher rack having pipes disposed at the bottom thereof, said pipes being provided with pivotably mounted short tubular members. In this type of design, in particular, these short tubular members are pivotably mounted to the pipes at the bottom of the rack in such a manner that when they are brought to their operative position by a simple pivoting movement, they thereby enable the supply of washing agent, thus allowing the washing agent to be used in a controlled manner.

This known prior art dish rack having so-called special washing zones has the disadvantage that the pipe ends project into the rack space, which makes it more difficult to move cups or glasses in the region of the rack. Moreover, using these special washing zones, only a very limited region in the rack is supplied with or covered by wash water.

French document FR 1.571.450 describes another prior art variant, where a so-called additional spray means is used in addition to a rotating spray arm, said additional spray means exerting its function especially in the upper rack. There, an additional arm is provided on the feed tube of the upper rack, said additional arm ensuring, in particular, that the items to be washed are intensively sprayed from above. This additional spray means still has disadvantages, because it does not act on the items to be washed from below as a so-called additional intensive washing zone.

SUMMARY OF THE INVENTION

In view of the above, it is an object of the present invention to provide a dish rack for a dishwasher, including a feed tube for a wash chamber, such that the cleaning efficiency is improved, especially from the underside, by additional intensive washing zones and in such a way that the configuration of the intensive washing zone will not impair the usability of the dish rack.

The present invention provides a dishwasher apparatus including a dish rack having a wire member, and a feed tube for a spray arm rotatably disposed beneath the dish rack. An intensive washing zone is disposed in a region of the dish rack, the intensive washing zone including a rod-shaped pipe element attached to the wire member and having an outlet nozzle. A pipe branch for the intensive washing zone is provided, the pipe branch being disposed in a region of the feed tube and being configured for communicating with the pipe element via a T-piece. An actuator configured to cooperate with the pipe element is provided as to enable the intensive washing zone to be activated and deactivated.

According to a first embodiment, the intensive washing zone is arranged beneath the pivotable cup support. To this end, the pipe elements are in communication with the pipe branch via a valve, the actuator being constituted by the cup support itself. This has the particular advantage that the intensive washing zone is always in the active position when the cup support is loaded with cups. Thus, the intensive washing zone is always automatically activated by the user. This eliminates the need for an additional actuator system. The valve is located in the region of the swivel axis of the cup support, the valve itself being formed by a pipe-in-pipe arrangement having openings that are aligned with each other. It is apparent that when the cup support is pivoted, the pipe-in-pipe arrangement is moved to the alignment position of the openings, thus activating the intensive washing zone beneath the cup support. Advantageously, the pipe elements are attached by retaining clips to the wire members of the cup support in such a way that the pipe elements can move relative to the underside of the cup support while the cup support is being pivoted. This prevents the intensive washing zone from getting jammed under the cup support, and thus allows the cup support to be readily pivoted in a simple fashion.

Arranging the pipe branch in the region of the feed tube for an intensive washing zone located beneath the rack will no longer impede the placement of the dishes in the rack. The intensive washing zone is preferably formed by rod-shaped pipe elements having outlet nozzles provided around the periphery thereof. The pipe elements are attached to the wire members of the rack. In this manner, the spray shadow areas can be reliably reached. The pipe elements are communication with the pipe branch via a T-piece.

According to a second advantageous embodiment, at least one pipe element is rotatably mounted and cooperates with a separate actuator in such a way that the intensive washing zone can be manually activated and deactivated as needed. In order to provide the capability of activation and deactivation, the rotatable pipe element has a mounting region for the actuator at its one end, while the other end is provided with a recess for providing the passage opening of the two pipe elements. It is apparent that the end portion of one of the two pipe elements acts as a valve to enable or disable the supply of wash water from the pipe branch to the intensive washing zone. In this connection, it is advantageous and preferable for the pipe branch to be disposed at the end portion of the feed tube. Since the feed tube extends to the center of the rack, there are no flow losses for pipe elements because they are each supplied with wash water over equal lengths.

BRIEF DESCRIPTION OF THE DRAWINGS

An exemplary embodiment of the present invention will be explained in more detail with reference to the following FIGS. 1 through 8, of which:

FIG. 3.1 is a cross-sectional side view showing the intensive washing zone of FIG. 2 in the closed position;

DETAILED DESCRIPTION

Figure 1:
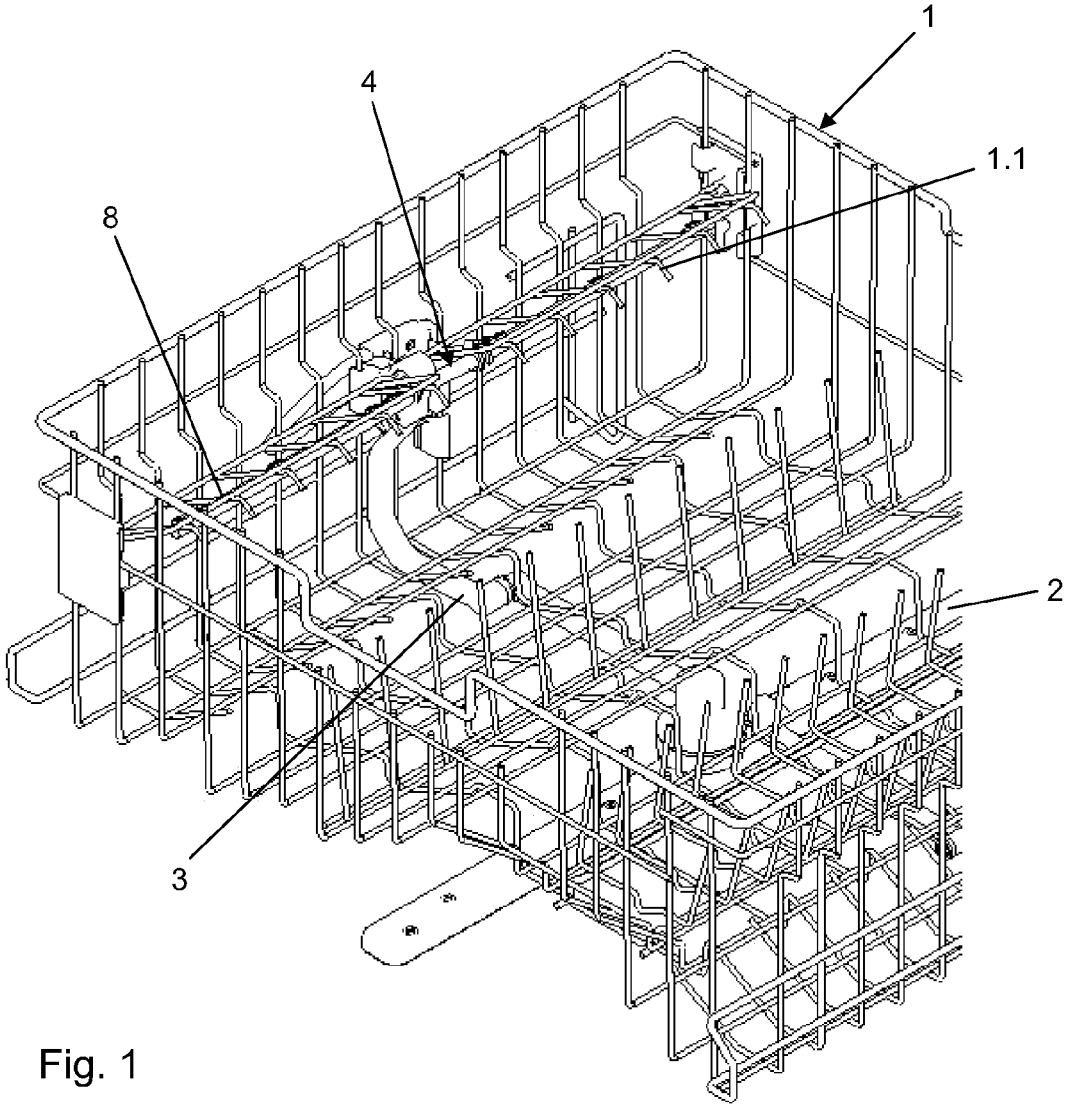
FIG. 1 is a perspective top view of an upper dish rack having an intensive washing zone beneath the pivotable cup support.
Figure 2:
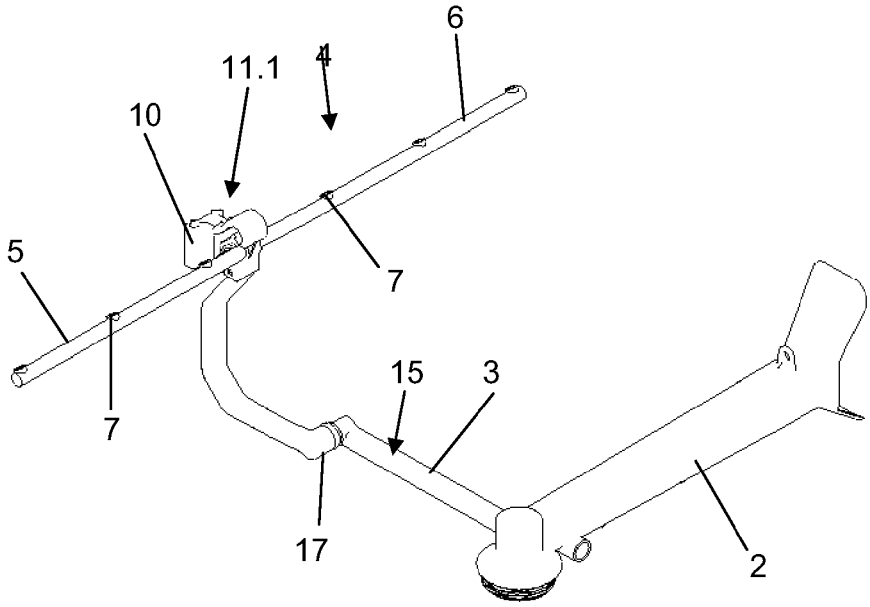
FIG. 2 is an isolated view of the intensive washing zone provided for an upper rack and cooperating with the cup support.

FIG. 1 is a perspective top view of a dish rack 1 for a dishwasher, including a feed tube 2 for a spray arm that is rotatably mounted beneath rack 1. In the region of feed tube 2, there is disposed a pipe branch 3 for an intensive washing zone 4 provided in the region of dish rack 1. The intensive washing zone is illustrated in isolated views preferably in FIGS. 2, 3 and 3.1. FIG. 2 clearly shows that intensive washing zone 4 is preferably formed by rod-shaped pipe elements 5 and 6, which are provided with outlet nozzles 7. Pipe elements 5 and 6 are attached to wire members 8 of rack 1 and connected to pipe branch 3 via a T-piece 10. As can be seen from FIG. 2, pipe elements 5 and 6 cooperate with an actuator 11 in such a way that intensive washing zone 4 can be activated and deactivated as needed.

Figure 3:
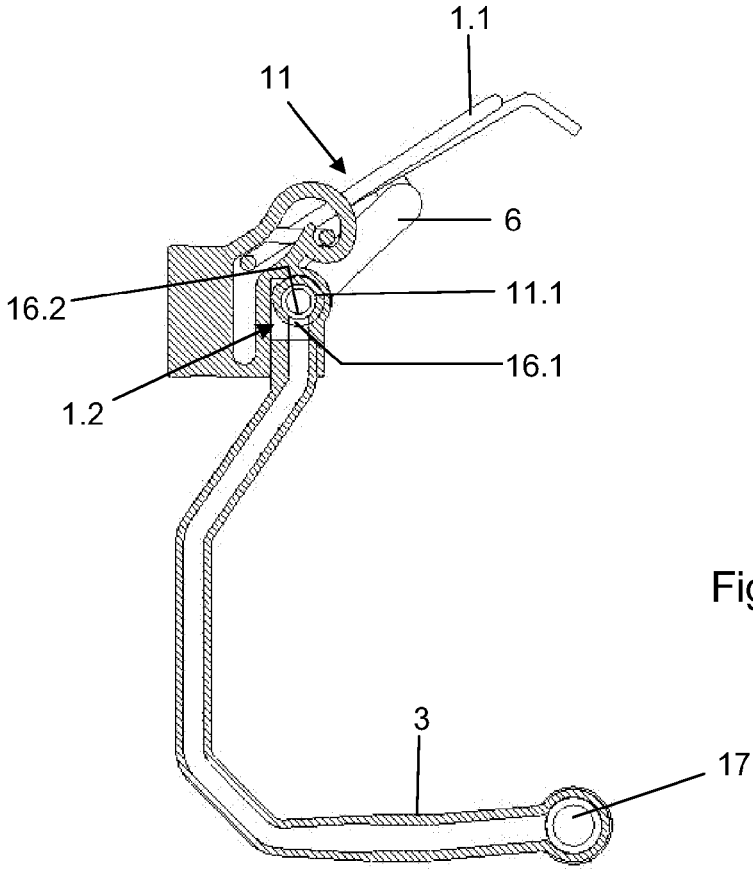
FIG. 3 is a cross-sectional side view showing the intensive washing zone of FIG. 2 in the open position.

In accordance with a first embodiment, intensive washing zone 4 is preferably arranged beneath pivotable cup support 1.1 of rack 1, as is clearly shown in particular in FIG. 3 and FIG. 3.1. The two pipe elements 5 and 6 are supplied with wash water through a valve 11.1, said valve 11.1 itself being in communication with pipe branch 3. Actuator 11 is constituted by cup support 1.1 itself, so that pivoting the cup support 1.1 will open or close valve 11.1. As is apparent when viewing cross-sectional FIGS. 3 and 3.1 together, valve 11.1 is located in the region of swivel axis 1.2 of cup support 1.1, the valve 11.1 itself being formed by a pipe-in-pipe arrangement having openings 16.1 and 16.2 that are aligned with each other when in the pass-through position, as is illustrated in FIG. 3. The combined view in FIG. 3.1 shows how valve 11.1 closes when cup support 1.1 is pivoted upward. When cup support 1.1 is in this position, opening 16.2 is rotated with respect to opening 16.1 in such a way that the passage of wash water to intensive washing zone 4 is interrupted.

Pipe elements 5 and 6 are attached by retaining clips to wire members 8 of cup support 1.1. The retaining clips allow pipe elements 5 and 6 to move slightly relative to wire members 8 of cup support 1.1 while cup support 1.1 is being pivoted. This allows cup support 1.1 to be pivoted in an unimpeded fashion.

FIG. 2 further shows that the connecting pipe between pipe branch 3 and valve 11.1 is formed by two L-shaped pipes which also form a pivot point 17 in the joint area.

Figure 4:
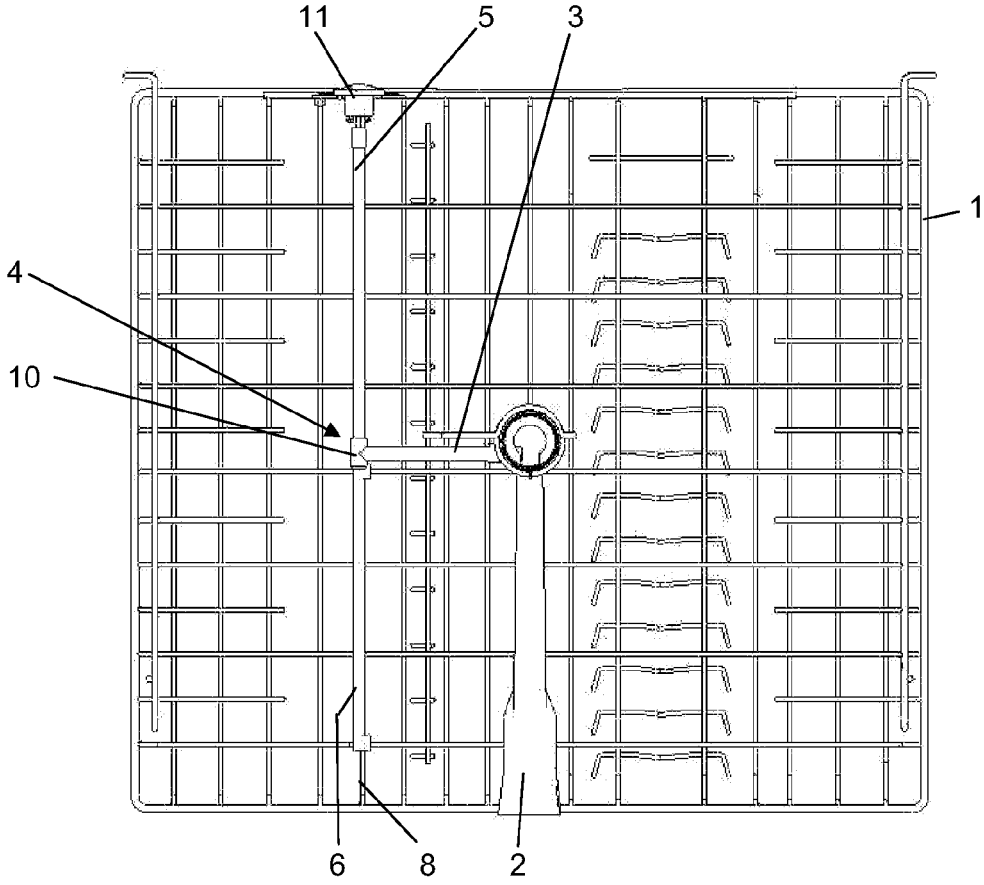
FIG. 4 is a top view of a dish rack having an intensive washing zone.

FIG. 4 shows a top view of a dish rack 1, here in particular the upper dish rack of a dishwasher. A feed tube 2 is in communication with dish rack 1, said feed tube supplying wash water to a spray arm, which is rotatably mounted beneath rack 1. At the end of feed tube 2, there is disposed a pipe branch 3 for an intensive washing zone 4 according to a second embodiment, which is provided in the region of dish rack 1 and can be seen more clearly in FIG. 5, where the operative connection between intensive washing zone 4 and feed tube 2 can be clearly seen, in particular in the perspective view. It is apparent that when feed tube 2 is supplied with wash water by the circulating pump, intensive washing zone 4 is supplied with wash water through pipe branch 3 as well.

Intensive washing zone 4 is advantageously located beneath rack 1, as can be seen in particular from FIG. 4. Thus, the intensive washing zone does not cause any obstruction in the region of the upper rack holding system. Preferably, intensive washing zone 4 is also formed by rod-shaped pipe elements 5 and 6 having outlet nozzles 7 provided around the periphery thereof, as is better shown in FIGS. 7 and 8. In order for intensive washing zone 4 to be securely held at the grid of the rack, pipe elements 5, 6 are attached to a wire member 8 of rack 1. To this end, pipe elements 5 and 6 may be provided with clip elements 9, which embrace wire member 8.

Figure 5:
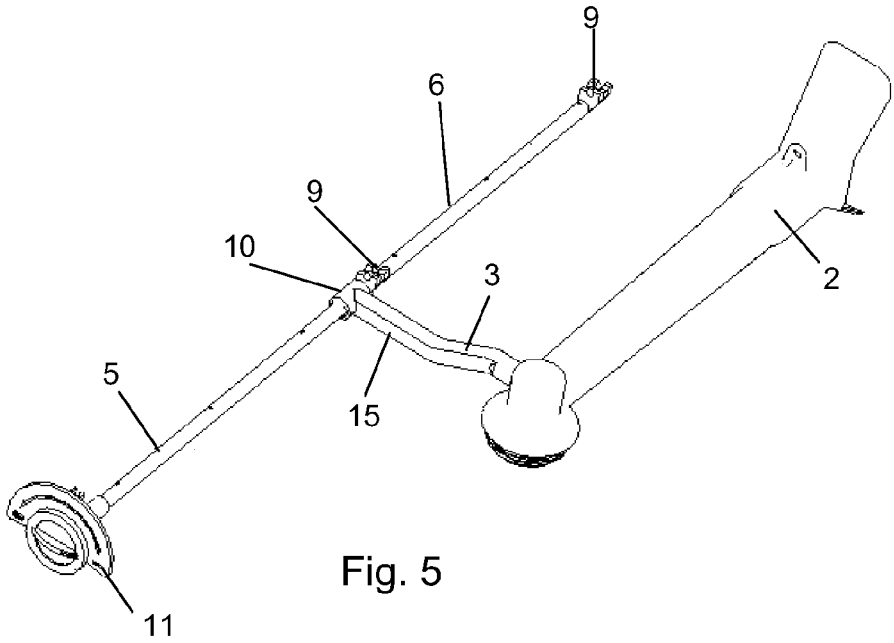
FIG. 5 is an isolated perspective view showing another embodiment of an intensive washing zone together with the feed tube.
Figure 6:
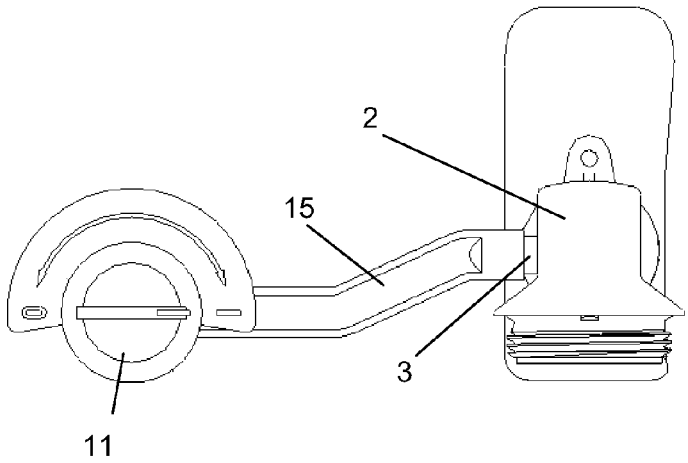
FIG. 6 is a front view of the intensive washing zone of FIG. 5, showing and pipe branch at the feed tube.
Figure 7:
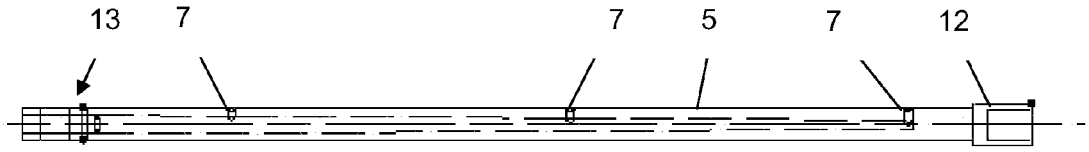
FIG. 7 is a top view of a rotatable pipe element according to the embodiment of FIG. 5.
Figure 8:
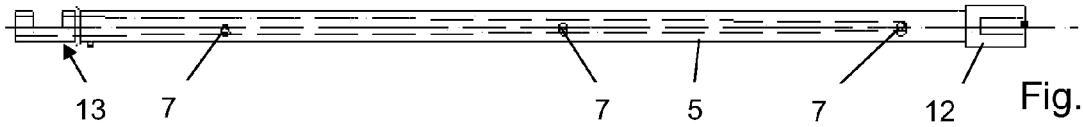
FIG. 8 is a side view of the rotatable pipe element of FIG. 7.

As is shown in the perspective view of FIG. 5, pipe elements 5 and 6 are communication with pipe branch 3 via a T-piece 10. The front pipe element 5, which is also shown isolated in FIGS. 7 and 8, is rotatably mounted and cooperates with actuator 11 in such a way that intensive washing zone 4 can be activated and deactivated as needed, as is shown in FIG. 6. In order to accomplish this, the rotatably mounted pipe element 5 has a mounting region for actuator 11 at its one end 12, while the other end 13 is provided with a recess 14, as is shown in FIGS. 7 and 8. In order to provide the passage opening of, or to close, the two pipe elements 5 and 6, recess 14 is rotated within T-piece 10.

It is apparent that when pipe element 5 is rotated 180°, either recess 14 faces pipe branch 3, so that intensive washing zone 4 is open, or the back region of recess 14 blocks pipe branch 3, so that no wash water may enter intensive washing zone 4. A corresponding control action can be performed using actuator 11, which, in the position illustrated, specifically shows the open position of intensive washing zone 4. Rotation of actuator 11 to the zero position, i.e., by 180°, deactivates intensive washing zone 4.

In an advantageous refinement of the present invention, intensive washing zone 4 may also be formed by a continuous rod-shaped pipe element which is provided with outlet nozzles and is in communication with feed tube 2 via pipe branch 3. A control valve may be provided in pipe section 15 of pipe branch 3 for purposes of activation and deactivation. The control valve itself is actuated by a rod, which is provided with a rotary knob, such as actuator 11.

What is claimed is:

1. A dishwasher apparatus comprising:

a dish rack including a wire member and a pivotable cup support, the pivotable cup support being configured to hold cups;

a feed tube for a spray arm rotatably disposed beneath the dish rack;

an intensive washing zone disposed in a region of the dish rack beneath the pivotable cup support, the intensive washing zone including a rod-shaped pipe element attached to the wire member and having an outlet nozzle;

a pipe branch for the intensive washing zone, the pipe branch being disposed in a region of the feed tube and being configured for communicating with the pipe element via a T-piece and a valve; and an actuator configured to cooperate with the pipe element so as to enable the intensive washing zone to be activated and deactivated, the actuator cooperating with the pivotable cup support such that pivoting of the pivotable cup support is operable to open and close the valve.

2. The dishwasher apparatus as recited in claim 1 wherein the intensive washing zone is disposed beneath the cup support.

3. The dishwasher apparatus as recited in claim 1 wherein the valve is disposed in a region of a pivot axis of the cup support and the valve includes a pipe-in-pipe arrangement having openings configured to align with each other.

4. The dishwasher apparatus as recited in claim 1 wherein the pipe element is attached to the wire member by a retaining clip configured to allow movement of the pipe element relative to the wire member when the pivotable cup support pivots.

5. The dishwasher apparatus as recited in claim 1 further comprising a connecting pipe connected between the pipe branch and the valve, the connecting pipe including a first L-shaped pipe.

6. The dishwasher apparatus as recited in claim 5 wherein the connecting pipe includes a second L-shaped pipe.

7. The dishwasher apparatus as recited in claim 1 wherein the pipe element is attached beneath the rack to the wire member.

8. The dishwasher apparatus as recited in claim 1 wherein the pipe element includes a further outlet nozzle, the outlet nozzle and the further outlet nozzle being disposed respectively at a periphery of the pipe element.

9. The dishwasher apparatus as recited in claim 1 wherein the pipe element is rotatably mounted and is configured to cooperate with the actuator so as to enable the intensive washing zone to be manually activated and deactivated as needed.

10. The dishwasher apparatus as recited in claim 9 wherein the pipe element includes a mounting region for the actuator at a first end of the pipe element thereof, and includes a recess at a second end of the pipe element thereof, the recess being configured to open or close passage of washing water to the pipe element.

11. The dishwasher apparatus as recited in claim 10 further comprising a second pipe element, the recess being configured to open or close passage of washing water to the second pipe element.

* * * * *